US008820435B2

(12) United States Patent
Niekamp

(10) Patent No.: US 8,820,435 B2
(45) Date of Patent: Sep. 2, 2014

(54) AUGER FOR DIGGING HOLES

(75) Inventor: Gary J. Niekamp, Jefferson City, MO (US)

(73) Assignee: Danuser LLC, Fulton, MO (US)

( * ) Notice: Subject to any disclaimer, the term of this patent is extended or adjusted under 35 U.S.C. 154(b) by 484 days.

(21) Appl. No.: 13/272,767

(22) Filed: Oct. 13, 2011

(65) Prior Publication Data

US 2012/0090896 A1 Apr. 19, 2012

Related U.S. Application Data

(60) Provisional application No. 61/392,616, filed on Oct. 13, 2010.

(51) Int. Cl.
*E21B 7/26* (2006.01)
*E21B 10/26* (2006.01)

(52) U.S. Cl.
CPC ..... *E21B 10/26* (2013.01)
USPC ..... 175/19; 175/57; 175/394

(58) Field of Classification Search
CPC ..... E21B 7/00; E21B 10/44
USPC ..... 175/19, 22, 23, 170, 184, 185, 187, 175/320, 323, 394; 173/28, 184
See application file for complete search history.

(56) References Cited

U.S. PATENT DOCUMENTS

| | | | | |
|---|---|---|---|---|
| 2,912,228 | A | 7/1957 | Kandle | |
| 3,896,570 | A | 7/1975 | McMurray | |
| 4,679,637 | A | 7/1987 | Cherrington et al. | |
| 4,938,297 | A * | 7/1990 | Schmidt | 175/19 |
| 5,042,600 | A * | 8/1991 | Finnegan et al. | 175/323 |
| 5,076,730 | A | 12/1991 | Bergey | |
| 5,101,912 | A | 4/1992 | Smet | |
| 5,797,705 | A * | 8/1998 | Kellner | 405/253 |
| 6,273,652 | B1 | 8/2001 | Wirth, Jr. et al. | |
| 6,619,413 | B2 | 9/2003 | Hamilton et al. | |
| 6,902,014 | B1 | 6/2005 | Estes | |
| 7,083,010 | B2 | 8/2006 | Eppink et al. | |
| 7,357,200 | B2 * | 4/2008 | Harleman | 175/323 |
| 2008/0223615 | A1 * | 9/2008 | Anderson | 175/19 |
| 2009/0194334 | A1 | 8/2009 | Johnson et al. | |

* cited by examiner

*Primary Examiner* — Nicole Coy
*Assistant Examiner* — Kristyn Hall
(74) *Attorney, Agent, or Firm* — Spencer Fane Britt & Browne, LLP

(57) ABSTRACT

An auger for digging holes that minimizes the amount of loose dirt excavated in and around the dug hole. The auger comprises an elongated shaft body whose axial longitudinal center is disposed in a parallel offset position from the axial engagement line of orientation with the driving source for rotationally driving the auger. The shaft body of the auger revolves in an eccentric lateral orbit as the auger rotates which digs the hole by pushing and widening the dirt in the hole rather than cutting and scraping. The distal end of the auger has a tapered configuration for initial penetration into the ground. The eccentric movement of the shaft body of the auger helps to compact the walls of the hole being dug.

14 Claims, 20 Drawing Sheets

AUGER FOR DIGGING HOLES

RELATED APPLICATIONS

The present non-provisional patent application claims priority benefit of an earlier-filed provisional patent application of the same title, Ser. No. 61/392,616, filed Oct. 13, 2010. The identified earlier-filed application is hereby incorporated by reference into the present application.

FIELD OF THE INVENTION

The present invention relates to digging equipment, and in particular, augers for digging holes in the ground. More particularly, the present invention relates to drilling post holes for fence posts or utility poles.

BACKGROUND OF THE INVENTION

A variety of methods are utilized to produce a post hole, involving both mechanized and non-mechanized means. Mechanized post hole diggers generally comprise a rotating auger having helical flighting and a cutting head to aid in loosening the soil to be excavated. As the auger rotates, the loosened soil is conveyed out of the hole by the screw-like movement action of the helical flighting formed into the auger. While the helical flighted type of auger effectively produces a hole, it leaves loose soil at the bottom of the hole and spatters the soil at the top of the hole surrounding it. It is typical for some of the excavated soil deposited around the top of the hole by the auger fighting to fall back into the hole during post installation. This requires a further step in removing the loose soil from the bottom of the post hole before a post is planted into the newly dug post hole.

An installed post should be stabilized to withstand and support a load, so it is desirable to compact the earth walls forming the post hole so that the post can be solidly planted to limit future settling of the post. In order to achieve a properly compacted hole, the loose soil must either be first removed by hand or compacted directly in place. Additionally, when setting posts in concrete, the soil that is excavated from the hole is replaced by concrete which requires the overburden soil to be removed after the post is set. Ensuring the soil is properly compacted and removing the excavated overburden soil can be very time consuming and labor intensive.

Although the auger's helical flighting effectively scrapes away earth to form the excavated post hole, the cutting action disturbs the stability of the hole wall and leaves the remaining wall subject to crumbling and degradation. Occasionally, it is advantageous to enhance the stability of the hole's wall by compacting the wall's surface. This action requires a further step after the use and retraction of the helical flighted auger, and the removal of the loose soil from the hole.

SUMMARY OF THE INVENTION

It is an object of the present invention to provide an auger that effectively digs a post hole while limiting the amount of loose soil generated from the digging of the post hole. An embodiment of the auger of the present invention comprises an elongated shaft body having a tapered end. The lateral surface of the shaft body is without helical flighting elements such that the ground in which the auger is inserted is effectively pushed outwardly to form the post hole, rather than excavated. The inventive auger limits the generation of loose soil which would otherwise remain in the post hole or be conveyed out of the post hole.

It is another embodiment of the present invention to provide an auger that imparts a compacting action against the post hole wall as the post hole is dug.

An embodiment of the auger of the present invention comprises an elongated shaft having a tapered end. The elongated shaft has a central longitudinal axis of the auger offset from the axial line of engagement with the rotational driving source of the mechanized implement to which it is connected. This configuration causes the auger to rotate in an eccentric rotational orbit as it is driven by the mechanized source. The auger digs the post hole by poking through the soil with the tapered end and pushing sideways against the earth though the back and forth lateral pushing forces by the shaft body.

It is another embodiment of the present invention to provide a method by which to dig a post hole that minimizes the amount of loose dirt generated by the creation of the post hole.

It is another embodiment of the present invention to provide a method by which the walls of a post hole are compacted as the post hole is dug.

These and other important features of the present invention are more fully described in the section titled DETAILED DESCRIPTION OF THE INVENTION, below.

DESCRIPTION OF THE DRAWINGS

Further features of the present invention will become apparent to those skilled in the art to which the present invention relates from reading the following description with reference to the accompanying drawings, in which.

DESCRIPTION OF THE INVENTION

Figure 1:
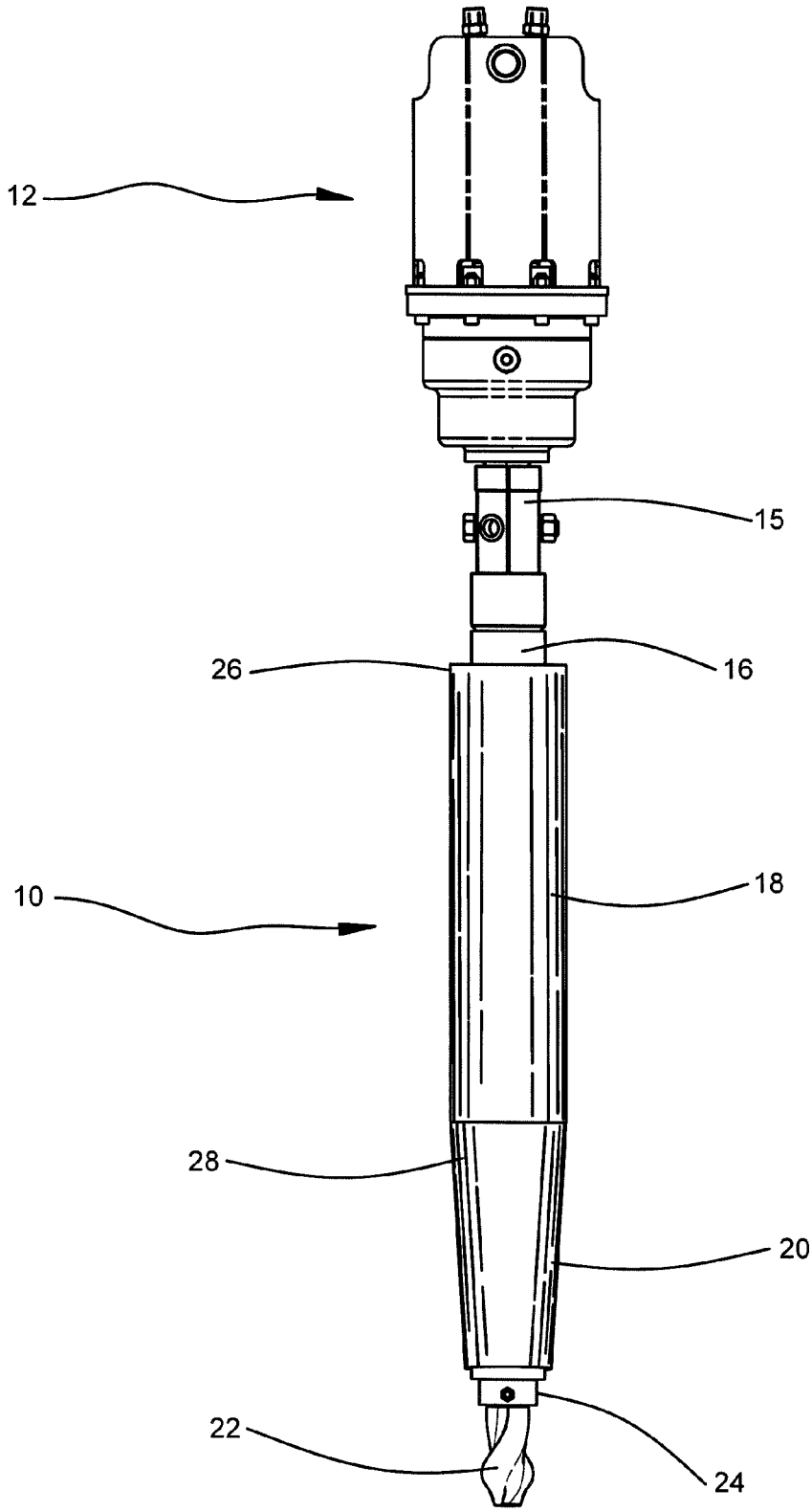
FIG. 1 is view in side elevation of an embodiment of the auger of the present invention.

Referring to the drawing figures, an embodiment of the inventive auger 10 is generally shown in FIG. 1. Auger 10 is adapted for connection to drive unit 12 which is commonly provided by a carrier machine, such as a skid steer loader (not shown), through means generally known to those having skill in the art. For example, auger attachment may be connected by bolting to drive spindle 14 of drive unit 12. FIG. 1 shows auger collar 15 as a female portion which receives male portion drive spindle 14 (hidden from view). Common drive spindle sizes include but are not limited to 1⅝ inch round, 2 inch round, 2 9/16 inch round, 2 inch hex, 2½ inch hex, 2⅝ inch hex, 4 inch square, and 6 inch square. The carrier machine provides a means to maneuver the auger into place and applies the hydraulic equipment required to lower the auger into the ground and retract it. The drive unit 12 is typically powered hydraulically or through mechanical means with the carrier machine being the source of power. The carrier machine can also be a tractor, excavator, backhoe or other suitable machine.

As shown in FIG. 1, auger 10 is comprised of elongated shaft column 16, auger shaft body 18, tapered shaft portion 20 and auger bit tip 22. The proximal end of elongated shaft column 16 connects through auger collar 15 to drive spindle 14 by bolting or other appropriate connector members. Elongated shaft column 16 runs the span of the auger and connects at its distal end to auger tip 22. Shaft column 16 may be comprised of a tubular metal but it can be of any number of different shapes or materials, for example an oval cross-sectional shape. A bit point adapter generally indicated at 24 is attached to the distal end of shaft column 16. Bit point adapter 24 is typically produced from cast or forged steel and may be configured with an internal socket or threads that allow the bit tip 22 to be attached. Bit tip 22 can be of any type normally used with augers of all types and is typically a cast or forged part that has a single or double helical flight shape wrapped around a cone shaped base. The leading edges of the helical shape are designed to engage the material being dug through and aid in penetration. Auger 10 is connected to the drive unit 12 such that shaft column 16 and bit tip 22 are oriented in axial alignment engagement with drive spindle 14.

Figure 2:
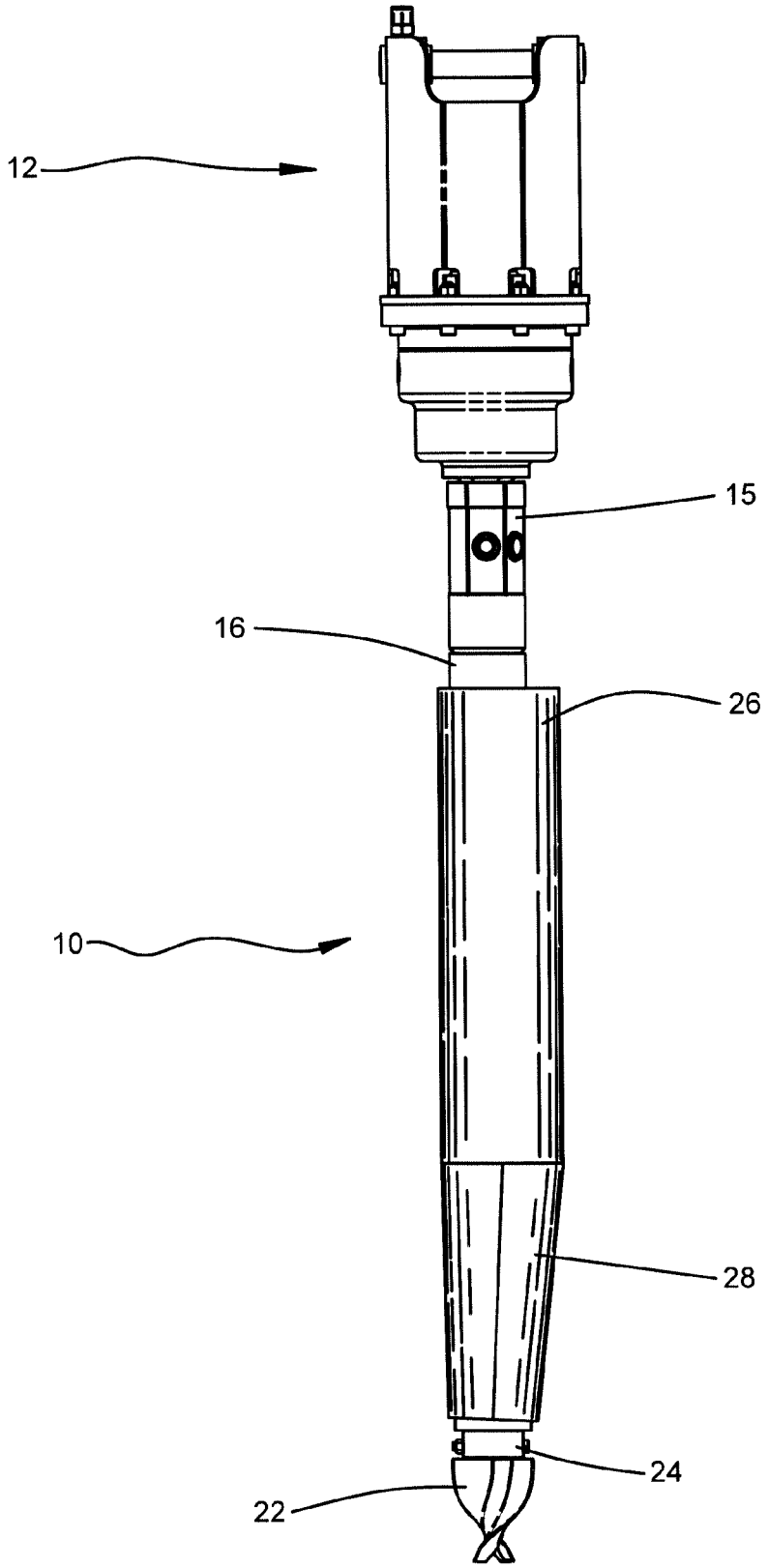
FIG. 2 is a view similar to FIG. 1 but rotated 90° to the left about the vertical axis.

Auger shaft body 18 comprises a cylindrical member 26 which extends along a substantial portion of shaft column 16 as shown in FIG. 1. Cylindrical member 26 is placed around and connected to shaft column 16 such that the central longitudinal axis of cylindrical member 26 runs parallel to, but offset from the longitudinal axis of shaft column 16. When viewing FIG. 1 in comparison to FIG. 2, it can be seen that the front edge of cylindrical member 26 is connected to shaft column 16 (by welding for example) leaving the back edge of cylindrical member 26 spaced apart from shaft column 16. This configuration effectively positions the central longitudinal axis of cylindrical member 26 offset from the central longitudinal axis of shaft column 16 as further seen in FIG. 4.

Figure 4:
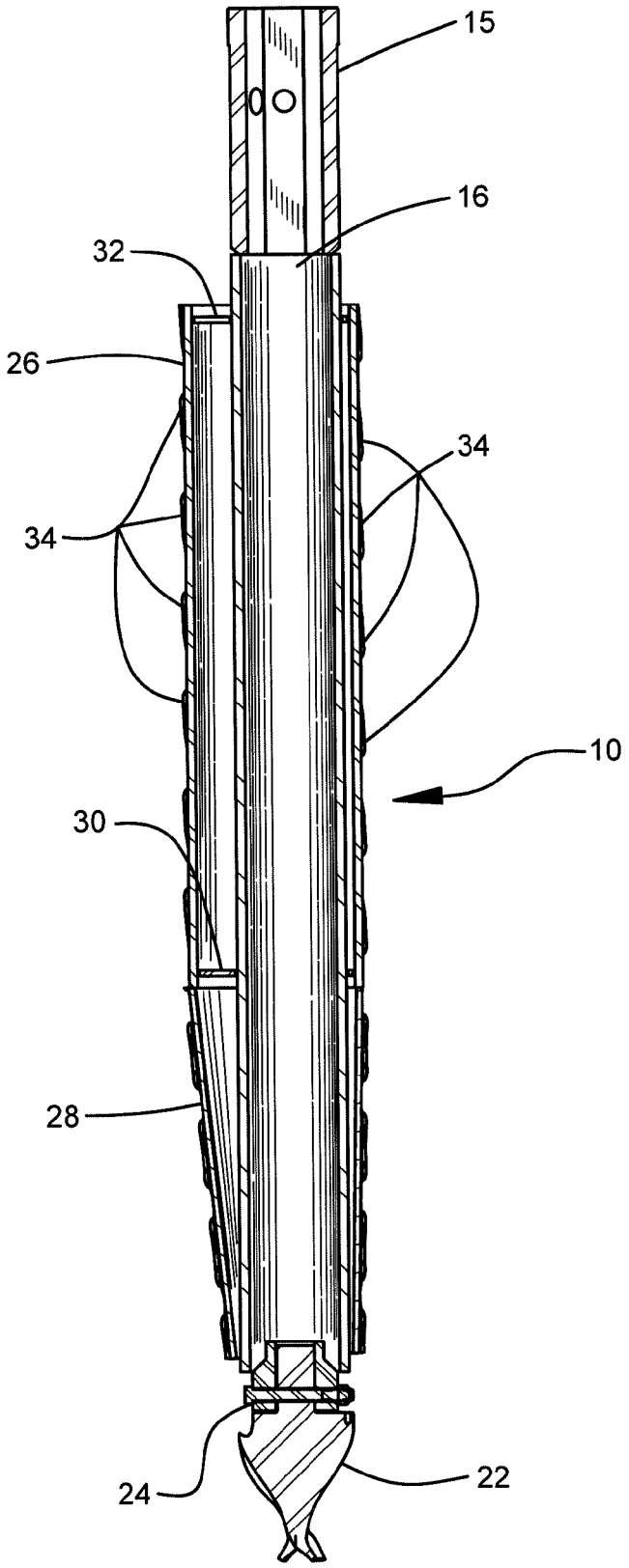
FIG. 4 is a cross-sectional view of an embodiment of the auger in side elevation taken along lines 4-4 in FIG. 3.
Figure 5:
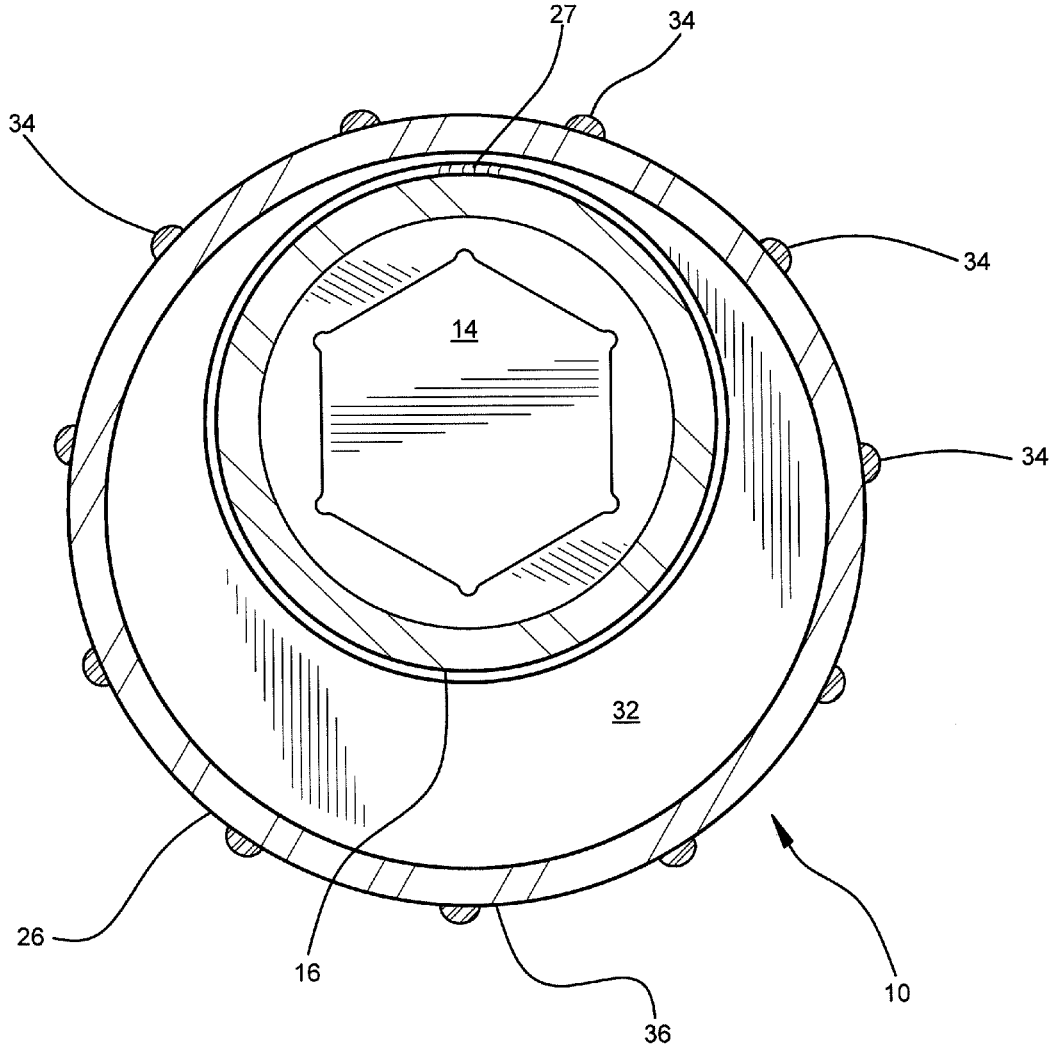
FIG. 5 is a cross-sectional view taken along lines 5-5 in FIG. 3.

Tapered shaft portion 20 comprises a cylindrical cone member 28. The preferred embodiment is a hollow cone made from steel but it can be fabricated from any number of materials or be solid instead of hollow. Cone member 28 is attached (by welding for example) such that the central axis of the cone lies transverse to the longitudinal axis of shaft column 16, placing cone member 28 at an angle with cylindrical member 26 as shown in FIG. 4. The amount of angle between cylindrical cone member 28 and shaft column 16 varies depending upon the different auger bit diameter used. Near the area of intersection between the cone member 28 and cylindrical member 26 is a reinforcing plate 30 as shown in FIG. 4. At the top of cylindrical member 26 is another reinforcing plate 32. These reinforcing plates provide for extra strength in these areas and prevent soil from becoming entrapped in the bit. Depending upon the construction method of the cylindrical cone and cylinder, these reinforcing plates can vary in size or necessity.

Auger 10 can also be made of a single integrated piece as opposed to welding together the individual components above described. Also, auger shaft body 18 may comprise an elliptical configuration, as opposed to a cylindrical configuration, so long as the central longitudinal axis of the overall shaft body is offset from the axial line of engagement of shaft column 16 with drive spindle 14.

Figure 3:
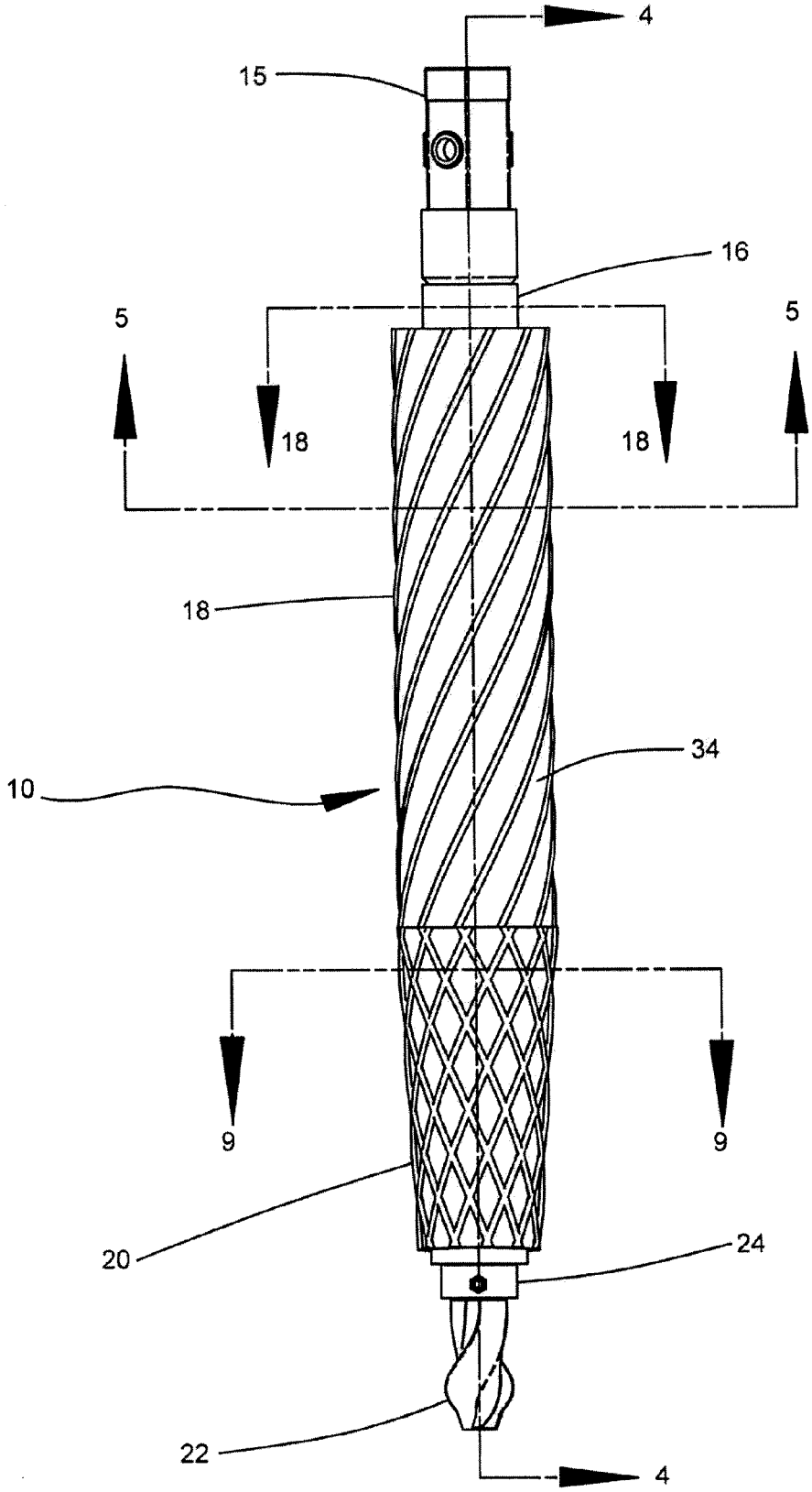
FIG. 3 is a view in side elevation of another embodiment of the auger.

The external surface of auger 10 can comprise a hard facing or provided with raised elements such as spiral or checkered hard facing 34 as shown in FIG. 3. This provides a durable wear surface and increases the auger's useful life. Also, auger 10 can terminate simply in tapered shaft portion 20 without an auger bit tip 22 when soil conditions permit it. In such cases, tapered shaft portion 20 may simply terminate in a narrow point or the like.

Figure 6:
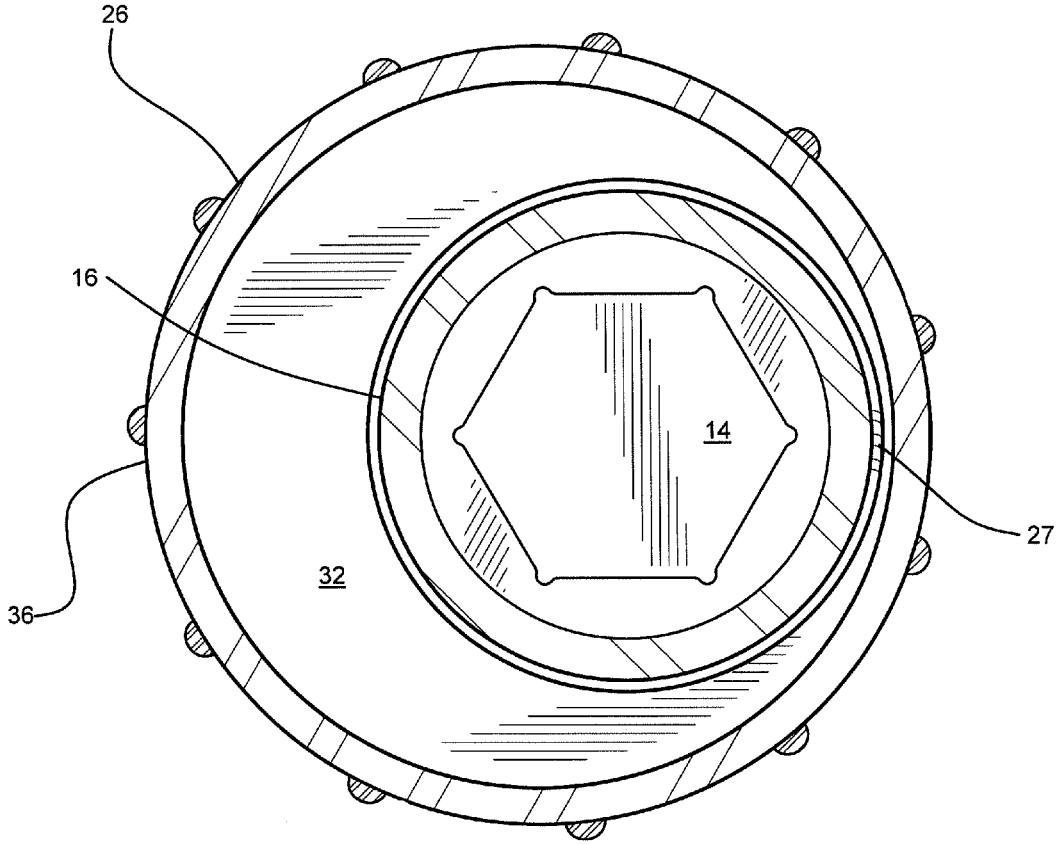
FIG. 6 is a view similar to FIG. 5 but rotated 90° clockwise.
Figure 7:
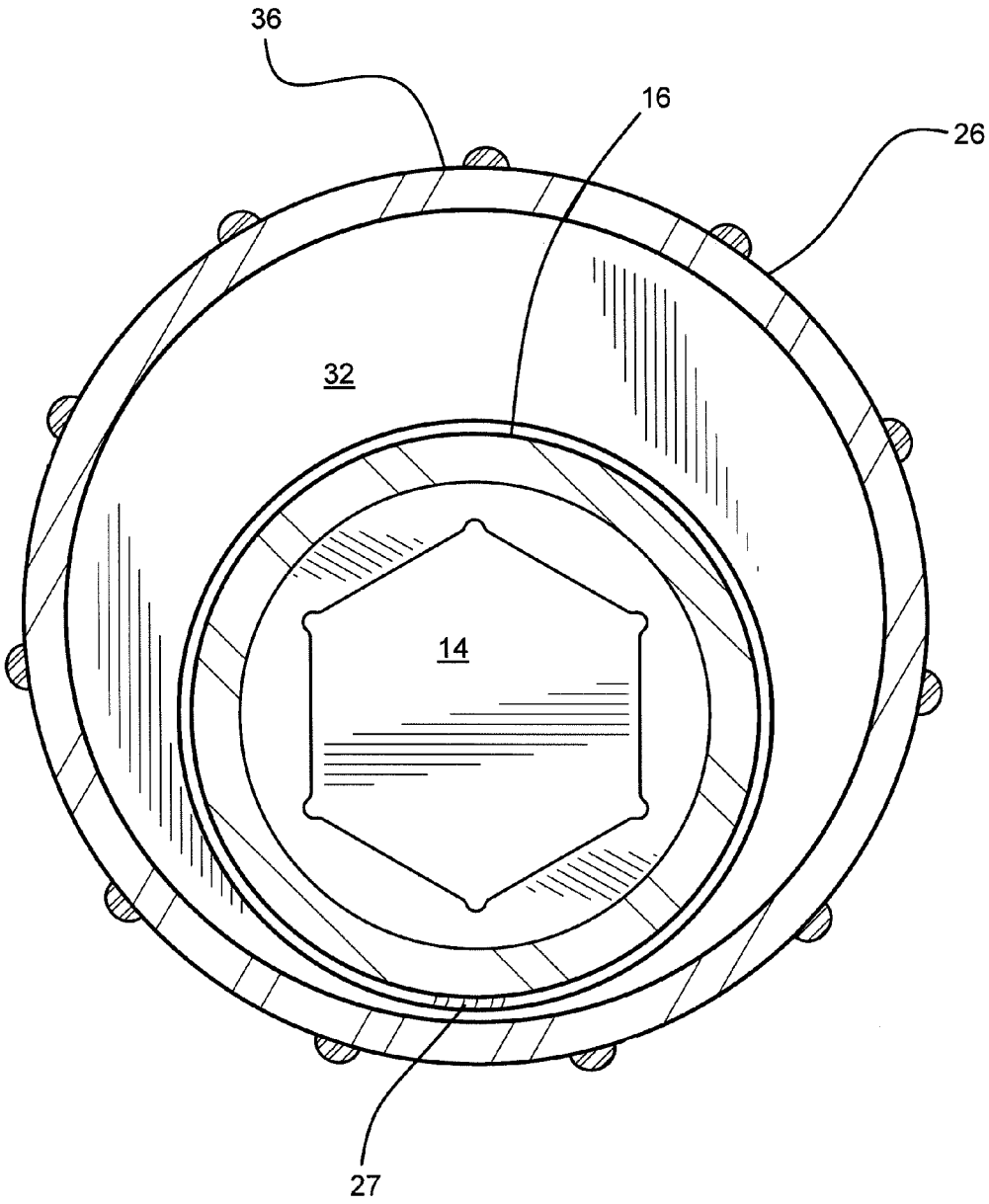
FIG. 7 is a view similar to FIG. 6 but rotated 90° clockwise.
Figure 8:
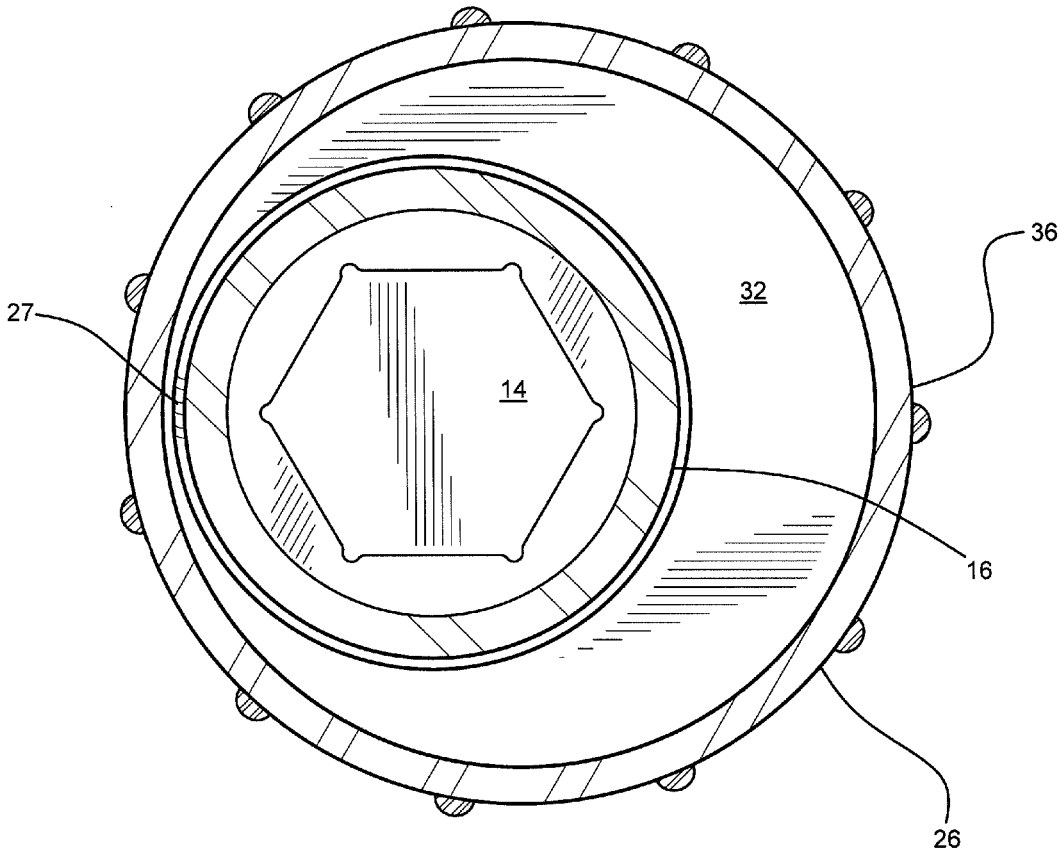
FIG. 8 is a view similar to FIG. 7 but rotated 90° clockwise.
Figure 9:
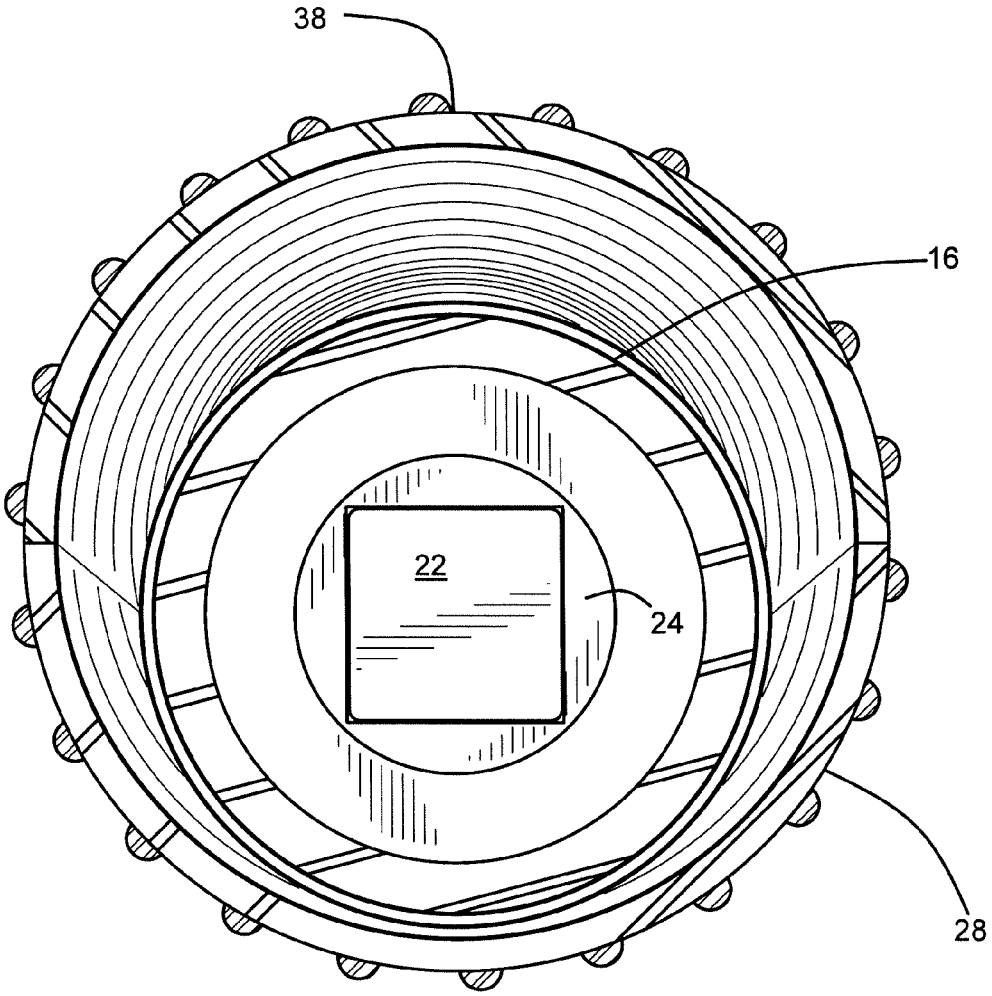
FIG. 9 is a cross-sectional view taken along lines 9-9 in FIG. 3.

The configuration of auger 10 as described confers an eccentric orbital rotation as shown in FIGS. 5-12. As first seen in FIG. 5, shaft column 16 engages drive spindle 14 to provide an axial alignment engagement with drive unit 12. Cylindrical member 26 is connected to shaft column 16 such that the central longitudinal axis of cylindrical member 26 is offset from shaft column 16. Cylindrical member 26 is shown in the figures as being connected to shaft column 16 through weldment 27. The attachment configuration creates an opposing auger engagement surface 36 on cylindrical member 26. As drive spindle 14 rotates to drive auger 10 90° as shown in FIG. 6, opposing auger engagement surface 36 moves in an eccentric orbit. It can be seen in FIGS. 7 and 8 that the displacement effect of opposing auger engagement surface 36 revolves with the rotation of auger 10.

Figure 10:
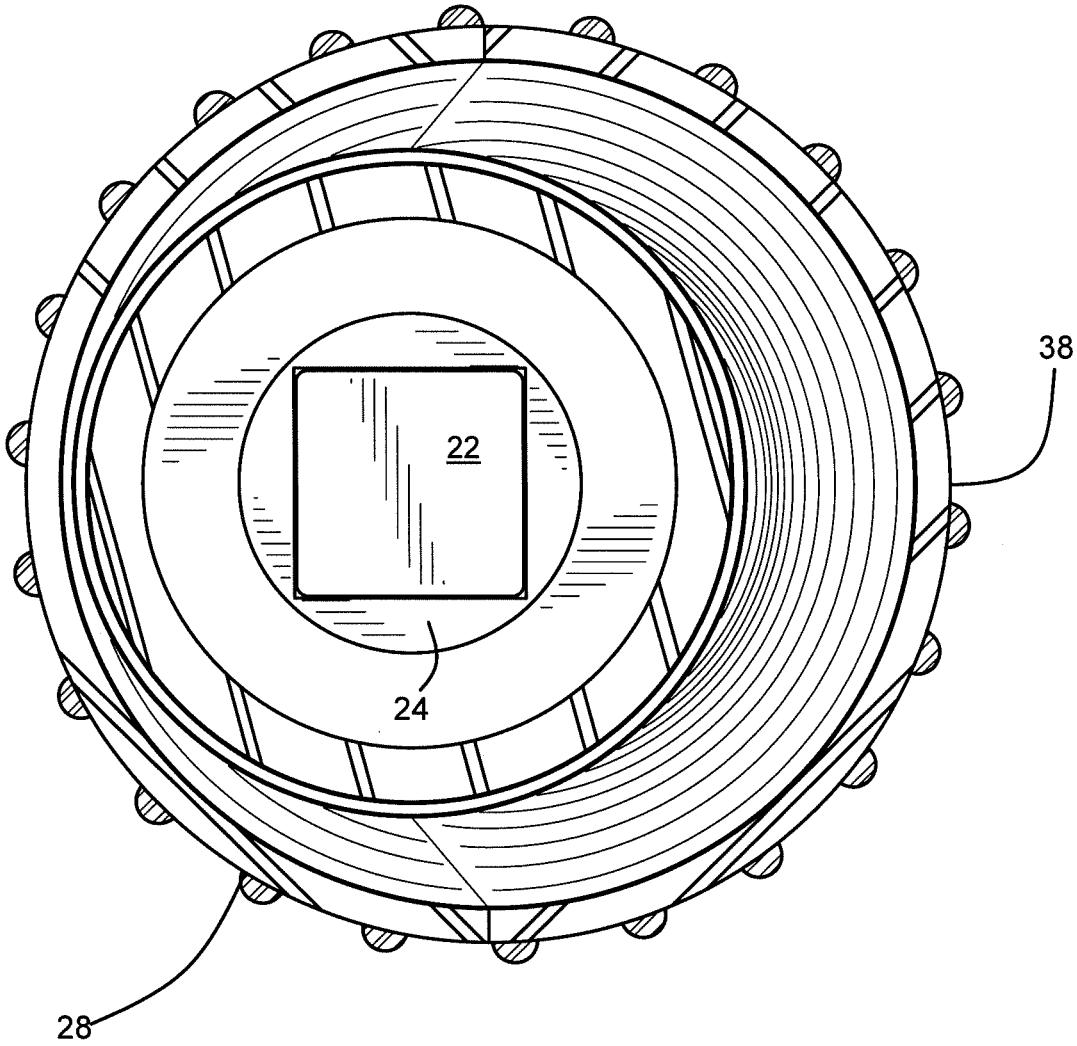
FIG. 10 is a view similar to FIG. 9 but rotated 90° clockwise.
Figure 11:
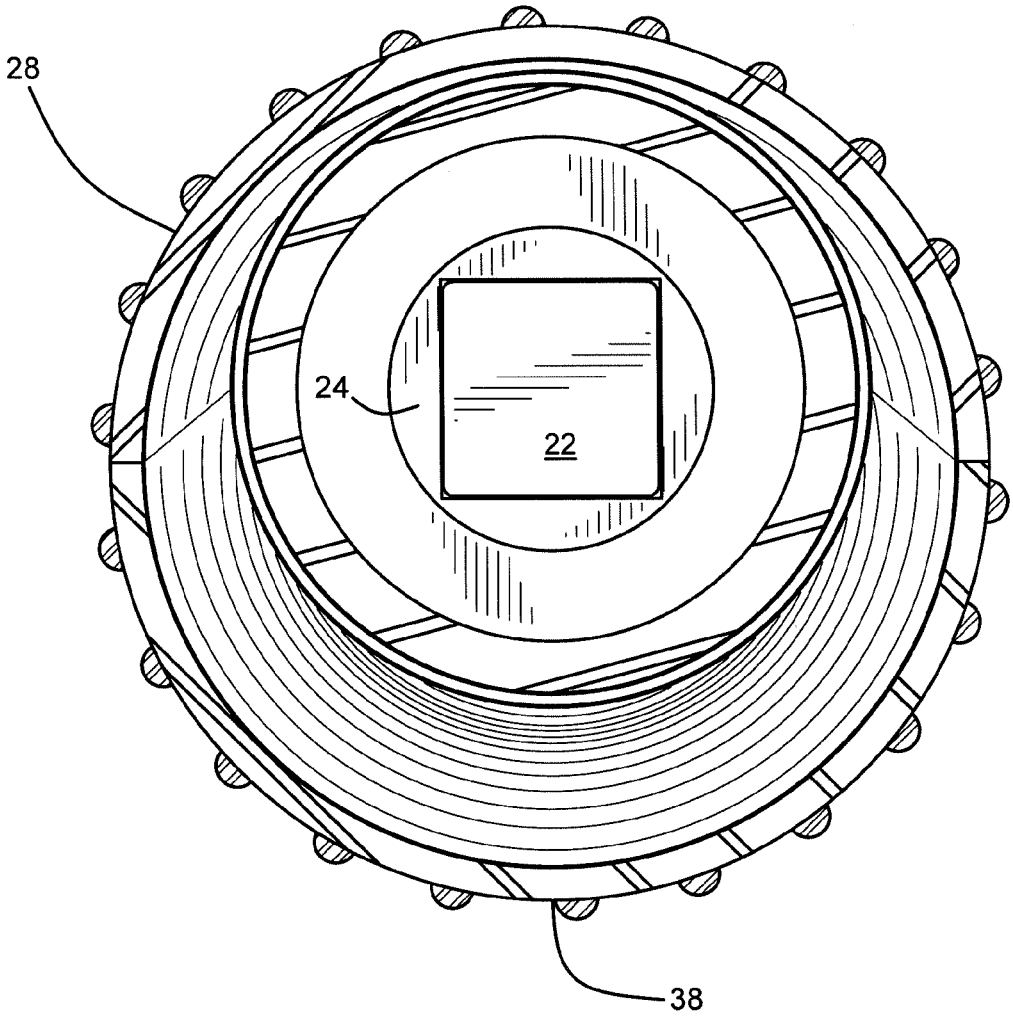
FIG. 11 is a view similar to FIG. 10 but rotated 90° clockwise.
Figure 12:
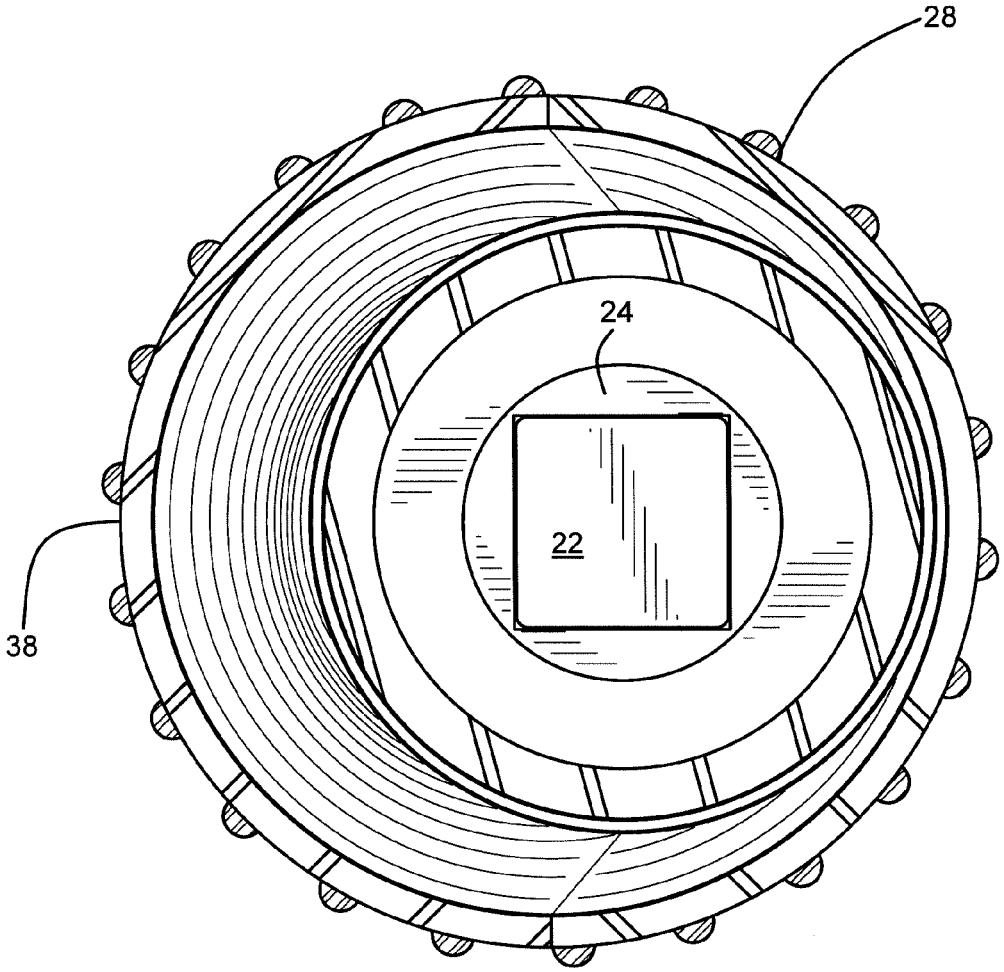
FIG. 12 is a view similar to FIG. 11 but rotated 90° clockwise.
Figure 13:
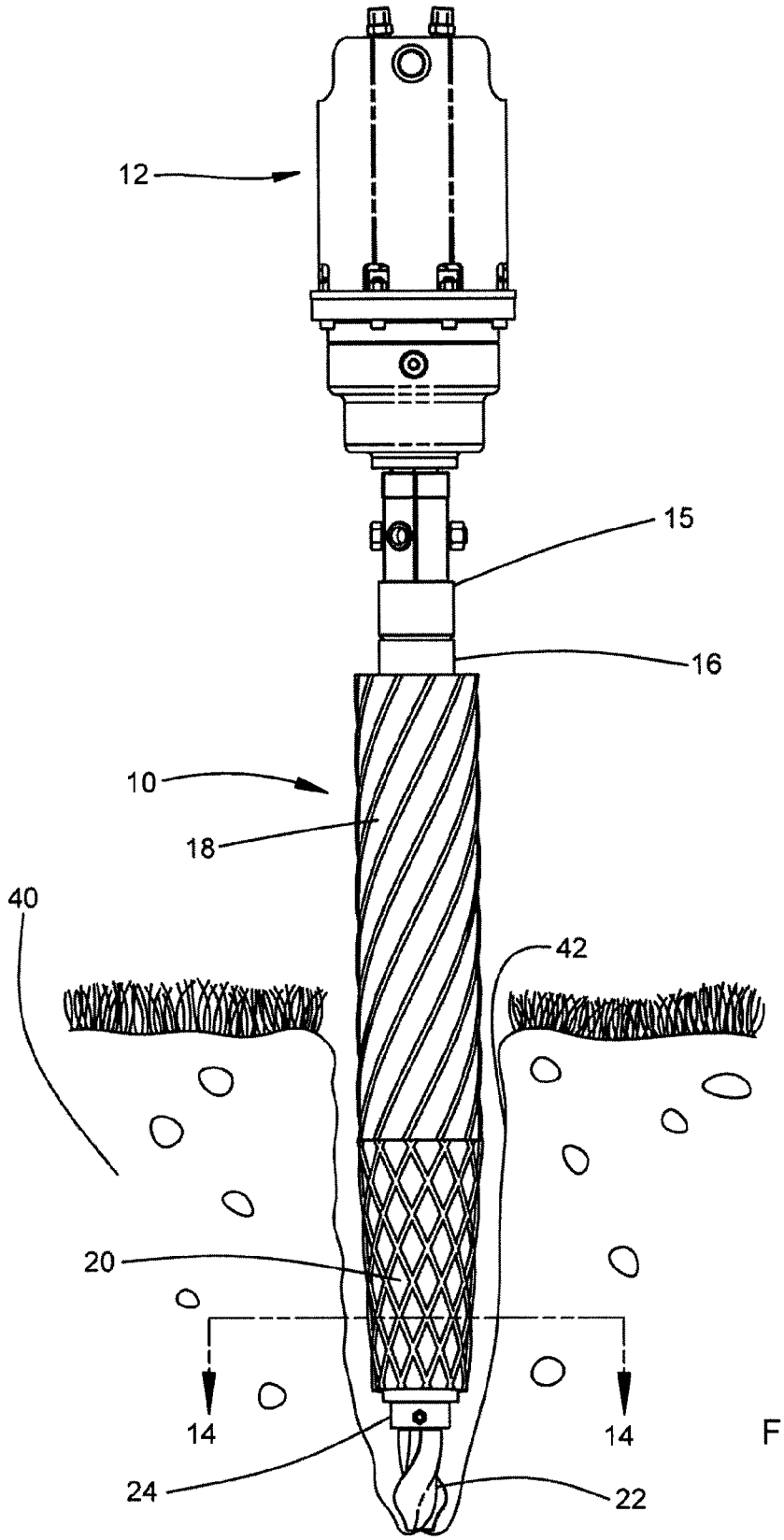
FIG. 13 is a perspective view of an embodiment of the auger penetrating the earth.

Similarly, cone member 28 is connected to shaft column 16 such that the central axis of cone member 28 lies at an angle to shaft column 16 as shown in FIG. 4. This creates an opposing auger engagement surface 38 on cone member 28. As auger 10 rotates to drive auger 10 90° as shown in FIG. 10, opposing auger engagement surface 38 moves in an eccentric orbit. It can be seen in FIGS. 11 and 12 that the displacement effect of opposing auger engagement surface 38 revolves with the rotation of auger 10.

Figure 14:
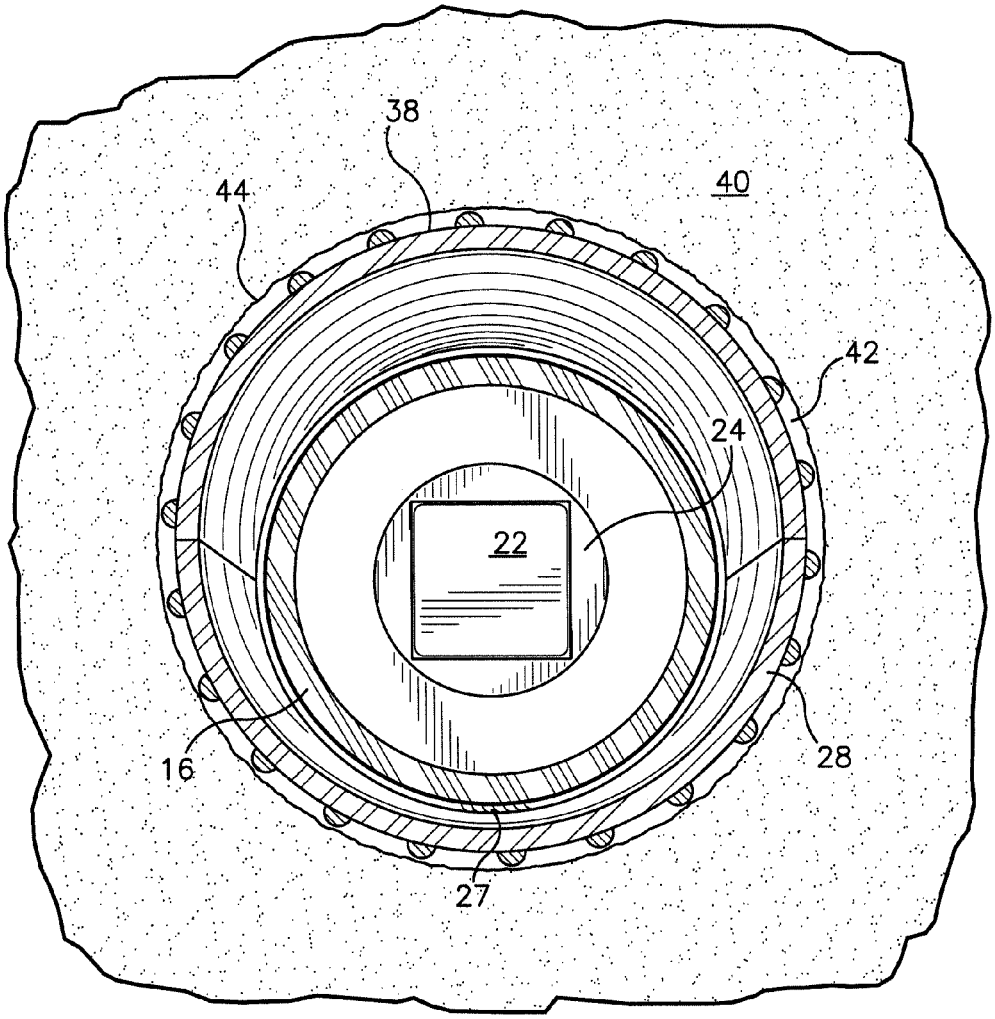
FIG. 14 is a cross-sectional view taken along lines 14-14 in FIG. 13.
Figure 15:
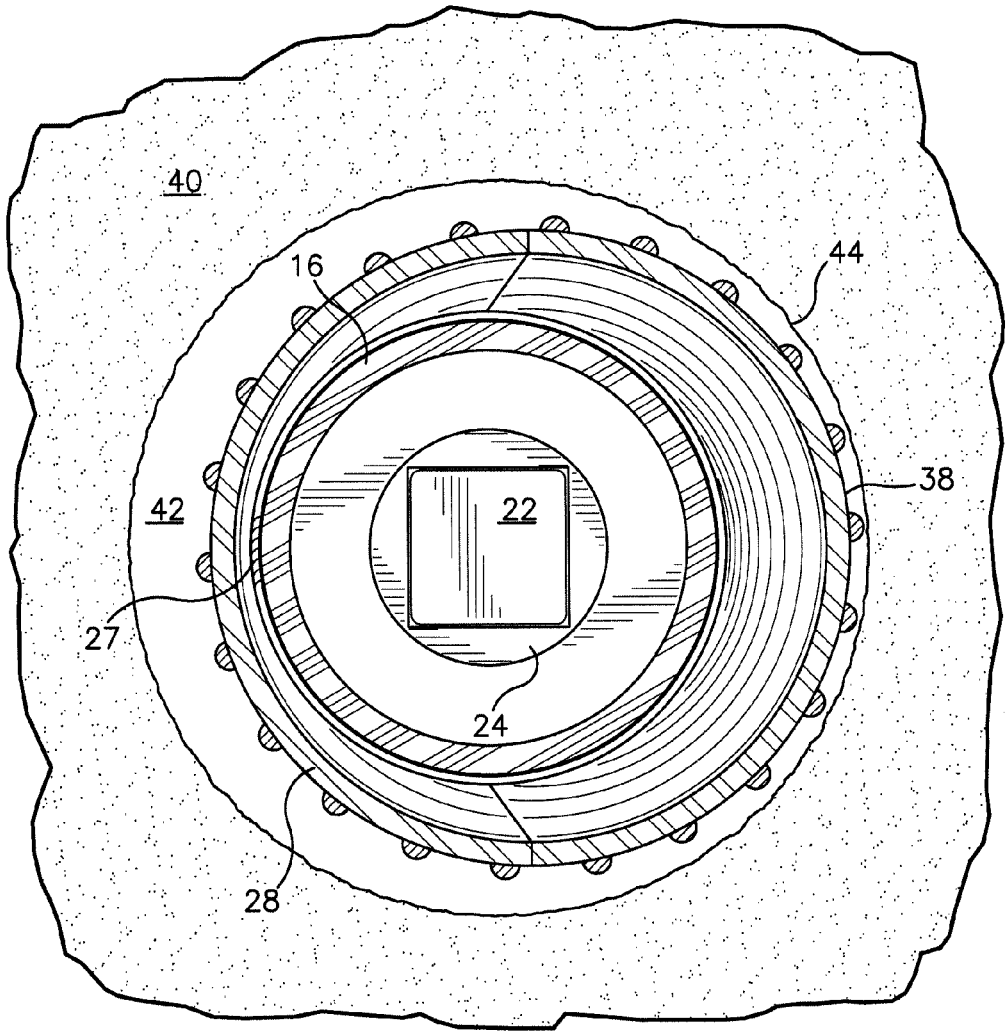
FIG. 15 is a view similar to FIG. 14 but rotated 90° clockwise pursuant to rotation of the auger as drilling proceeds.
Figure 16:
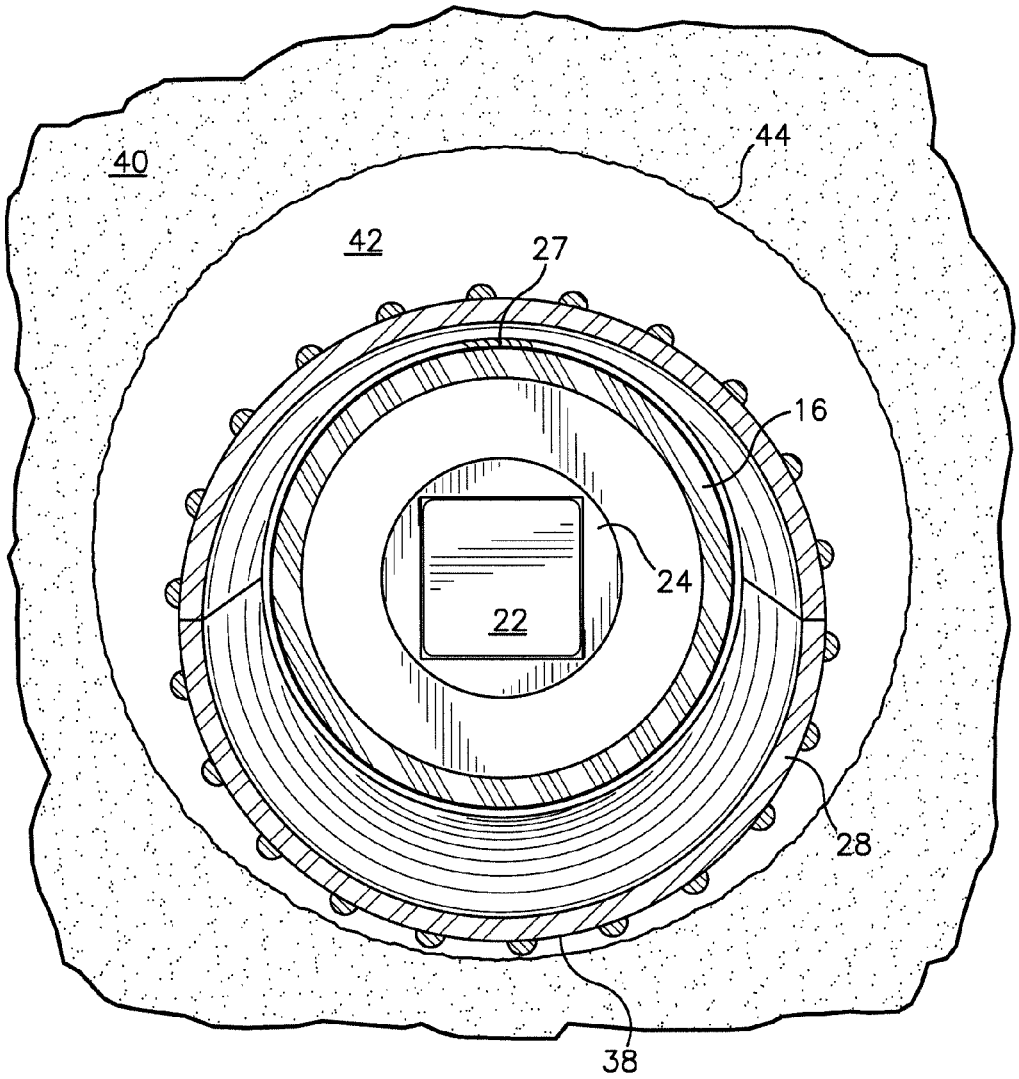
FIG. 16 is a view similar to FIG. 15 but rotated 90° clockwise pursuant to further rotation of the auger as drilling proceeds.
Figure 17:
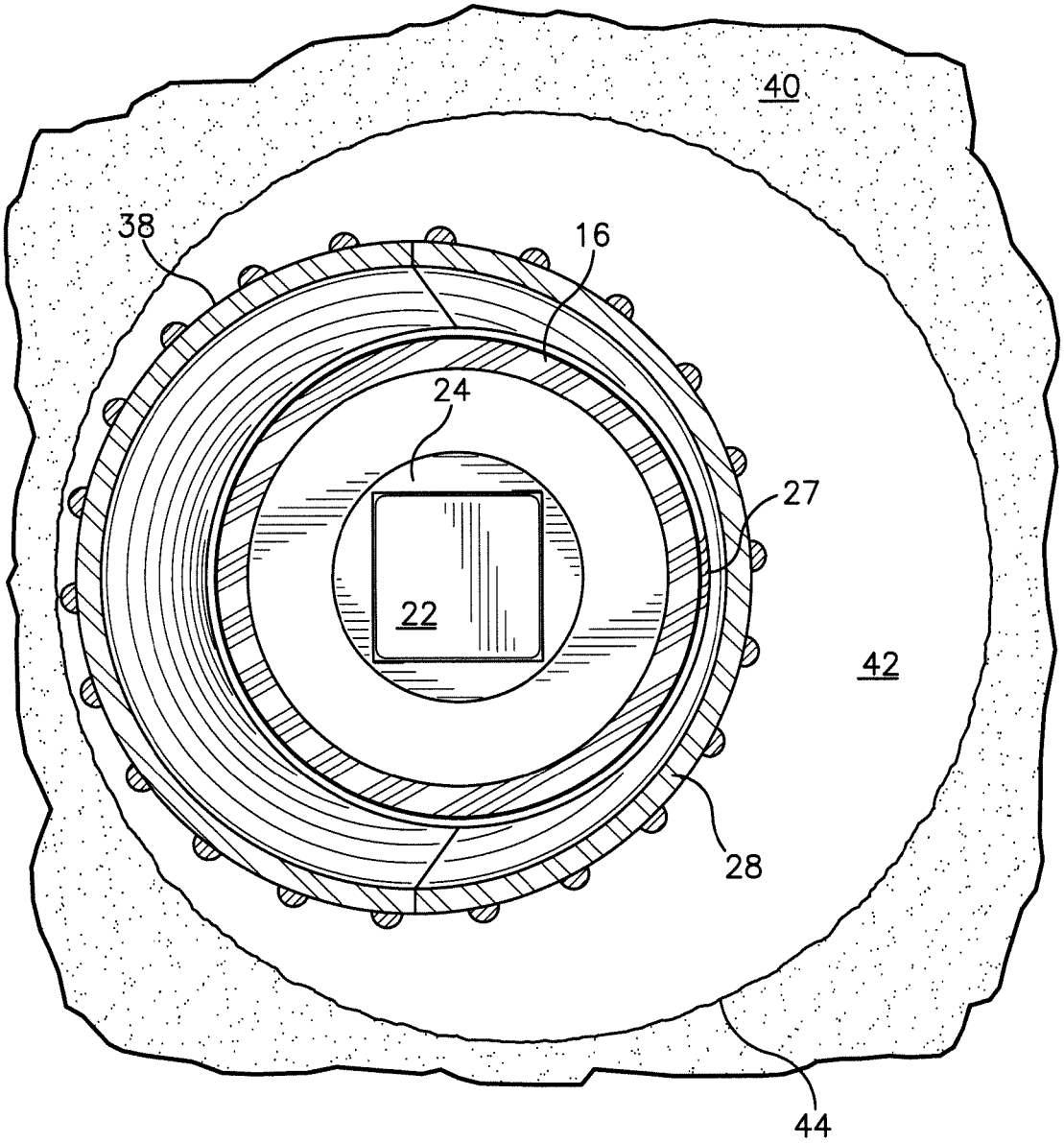
FIG. 17 is a view similar to FIG. 16 but rotated 90° clockwise pursuant to further rotation of the auger as drilling proceeds.
Figure 18:
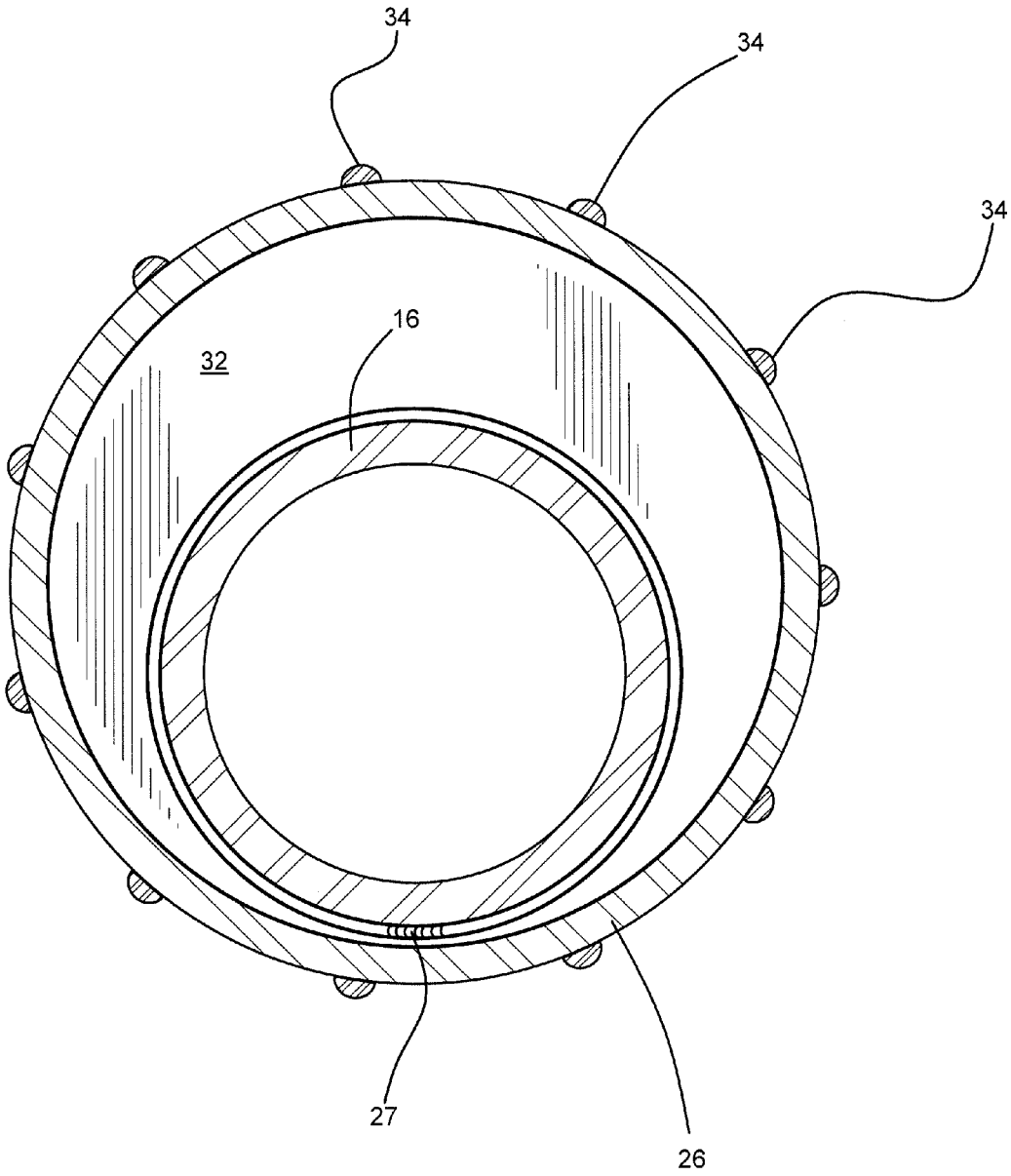
FIG. 18 is a cross-sectional view taken along lines 18-18 in FIG. 3.

FIGS. 13-17 show the effective operation of auger 10 as it penetrates into the ground 40 in digging a post hole 42. As taper shaft portion 20 first penetrates into the ground 40 as shown in FIG. 14, opposing engagement surface 38 pushes laterally outwardly against ground 40 to begin to create a widening of the post hole at the relative 12:00 position shown. Because the outer surface of tapered shaft portion is without helical flighting, the creation of loose soil is minimized and remains intact in the walls of the widening post hole. In FIG. 15, as auger 10 rotates 90°, opposing engagement surface 38 moves along dirt wall 44 of post hole 42 to the 3:00 position. Because cone member 28 rotates in an eccentric orbit, opposing engagement surface 38 pushes outwardly against dirt wall 44 to effectively widen post hole 42 along the arc between the 12:00 position and the 3:00 position. It can be seen that an area already passed over by opposing engagement surface 38 from the previous position shown in FIG. 14 effectively forms developing post hole 42. In FIG. 16, as auger 10 rotates a further 90°, opposing engagement surface 38 moves along dirt wall 44 of post hole 42 to the 6:00 position, effectively widening post hole 42 along the arc between the 3:00 position and the 6:00 position. In FIG. 17, as auger 10 rotates yet a further 90°, opposing engagement surface 38 moves along dirt wall 44 of post hole 42 to the 9:00 position, effectively widening post hole 42 along the arc between the 6:00 position and the 9:00 position. As auger 10 continues to rotate and is driven down by drive unit 12, cylindrical member 26 descends down into post hole 42 to contribute to the widening action begun by cone member 28 until the appropriate depth for post hole 42 is reached. The eccentric lateral orbit about which auger 10 revolves effectively causes dirt wall 44 to be expanded as auger shaft body 18 and tapered shaft portion 20 rotate in creating post hole 42. Also, the back and forth engagement of auger shaft body 18 against dirt wall 44 acts to compact dirt wall 44 and the lateral soil area to provide a post hole having substantial structural integrity. Furthermore, the generation of loose soil around the entry point of the auger is minimized.

Figure 19:
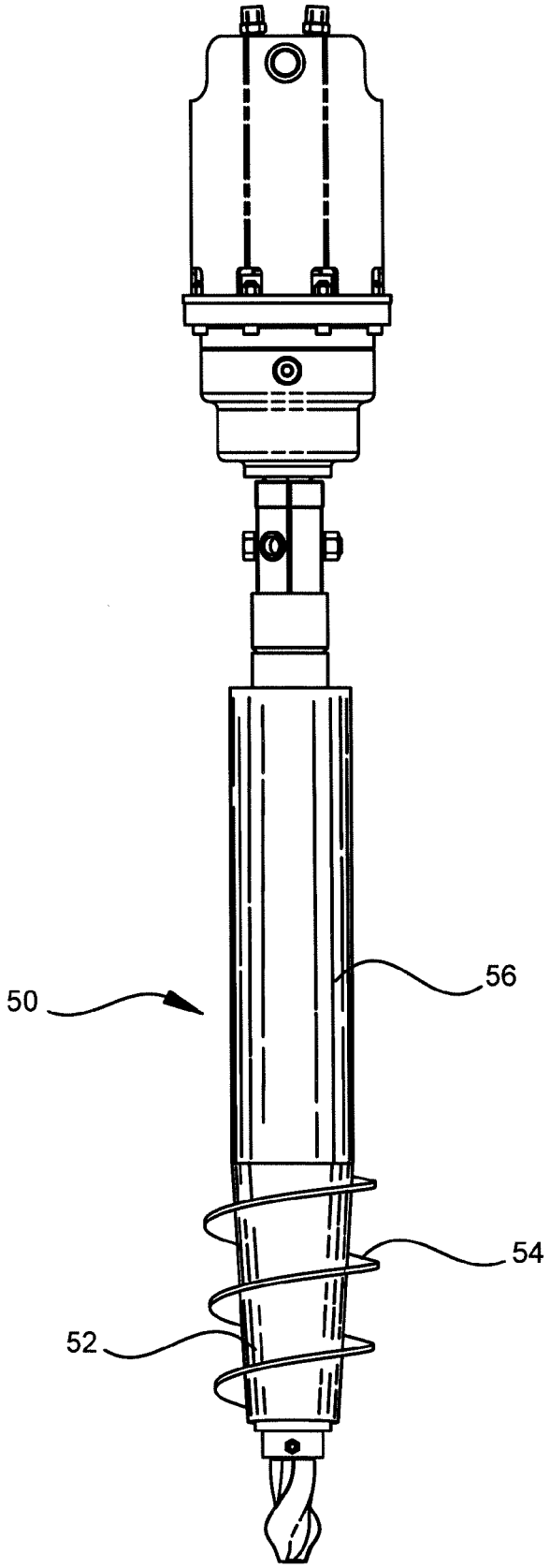
FIG. 19 is a view in side elevation of another embodiment of the auger of the present invention.

In another embodiment of the invention, auger 50, shown in FIG. 19, which otherwise has a structure similar to auger 10, comprises a cylindrical cone member 52 having helical flighting 54 formed into its outer surface. The helical flighting 54 aids in cutting and scraping dirt in initial penetration of the auger. As auger 50 continues to push through the dirt in forming the hole, cylindrical member 56 moves in an eccentric orbit to aid in compacting the wall of the formed hole.

Figure 20:
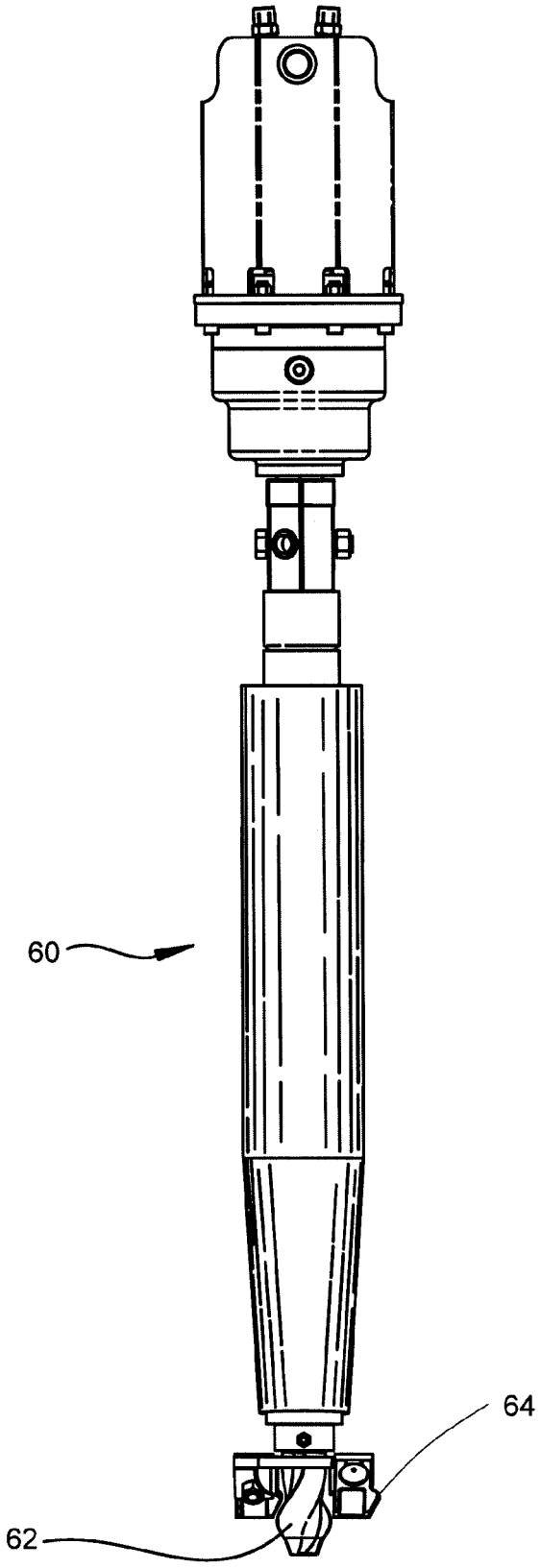
FIG. 20 is a view in side elevation of another embodiment of the auger of the present invention.

In yet another embodiment of the invention, auger 60, shown in FIG. 20, which otherwise has a structure similar to auger 10, comprises a bit tip 62 having additional cutting teeth 64. The cutting teeth 64 aids in cutting and scraping dirt in initial penetration of the auger.

In yet another embodiment of the invention, the auger can comprise a unitary shaft body, rather than joining together a separate cylinder member attached to shaft column. In other words, referring to FIG. 4, cylinder member 26, shaft column 16 and cone member 28 could instead comprise a unitary piece. The unitary piece would attach to the drive unit 12 and drive spindle 14 in the same manner such that the axial center of the auger would be disposed in a parallel offset position from the axial line of engagement of the auger with the drive unit as generally shown in FIGS. 1-4.

Having thus described the preferred embodiment of the invention, what is claimed as new and desired to be protected by Letters Patent includes the following:

1. An auger comprising an elongated shaft body having a proximal end for operative connection with a driving source for rotationally driving the auger about said auger's own longitudinal axis and a distal end adapted for engagement with a ground surface to effect penetration, the shaft body having an axial engagement line of orientation adapted for alignment with the driving source, the shaft body comprising an axial center disposed in a parallel offset position from the axial engagement line of orientation, the distal end comprising a tapered configuration, whereby the shaft body of the auger revolves in an eccentric lateral orbit as the auger is rotationally driven.

2. The auger of claim 1 in which the shaft body comprises a cylindrical configuration.

3. The auger of claim 1 in which the tapered configuration comprises a conically shaped member, a central axis of the conically shaped member lying transverse to the axial engagement line of orientation.

4. The auger of claim 1 in which the shaft body comprises raised surface elements for imparting a hardened surface thereto.

5. The auger of claim 4 in which the raised surface comprises a spiral hard facing.

6. The auger of claim 4 in which the raised surface comprises a checkered hard facing.

7. An auger comprising a central shaft member, a cylindrical sleeve member, a bit tip, the central shaft member being adapted for operative connection with a source for rotationally driving the auger about said auger's own longitudinal axis the cylindrical sleeve being connected to the shaft member such that a central axis of the cylindrical sleeve is spaced apart from a central axis of the shaft member, the bit tip being attached to the auger in coaxial alignment with the shaft member, whereby rotation of the auger causes the cylindrical sleeve to rotate in an eccentric revolving movement about the axis of the shaft member.

8. The auger of claim 7 in which a distal end of the cylindrical sleeve comprises a tapered configuration.

9. The auger of claim 8 in which the tapered configuration comprises a conically shaped member, a central axis of the conically shaped member lying transverse to the axial engagement line of orientation.

10. The auger of claim 8 in which the tapered configuration comprises a surface having helical flighting.

11. The auger of claim 8 in which the bit tip comprises cutting teeth.

12. A method for digging a post hole by employing an auger comprising an elongated shaft body comprising an axial center disposed in a parallel offset position from an axial line of engagement of the shaft body with a driving source, a distal end of the shaft body comprising a tapered configuration, and causing the shaft body of the auger to revolve in an eccentric lateral orbit as the auger is rotationally driven about said auger's own longitudinal axis by the driving source, whereby the hole is dug by pushing surrounding ground laterally outwardly to define the post hole as the auger penetrates the ground.

13. The method according to claim 12 in which the auger avoids creation of loose soil around an entry point of the auger into the ground.

14. The method according to claim 12 in which the eccentric lateral orbit of the shaft body engages the surrounding ground with lateral force to compact soil lying adjacent a wall of the post hole.

* * * * *